US007549895B2

(12) United States Patent
Kondo et al.

(10) Patent No.: US 7,549,895 B2
(45) Date of Patent: Jun. 23, 2009

(54) ELECTRIC CONNECTOR

(75) Inventors: Hayato Kondo, Yao (JP); Takayuki Nagata, Yao (JP)

(73) Assignee: Hosiden Corporation, Yao-shi (JP)

( * ) Notice: Subject to any disclaimer, the term of this patent is extended or adjusted under 35 U.S.C. 154(b) by 0 days.

(21) Appl. No.: 12/071,094

(22) Filed: Feb. 15, 2008

(65) Prior Publication Data

US 2008/0214042 A1 Sep. 4, 2008

(30) Foreign Application Priority Data

Mar. 2, 2007 (JP) ..... 2007-052719

(51) Int. Cl.
*H01R 13/58* (2006.01)

(52) U.S. Cl. ..... 439/579; 439/606; 439/942

(58) Field of Classification Search ..... 439/497–499, 439/579, 606, 701, 719, 874, 942
See application file for complete search history.

(56) References Cited

U.S. PATENT DOCUMENTS 4,074,929 A * 2/1978 Krider ..... 439/398
6,273,753 B1 * 8/2001 Ko ..... 439/579
6,338,652 B1 * 1/2002 Ko ..... 439/579
6,398,597 B1 * 6/2002 Ko ..... 439/858
6,428,344 B1 * 8/2002 Reed ..... 439/455
6,544,050 B1 * 4/2003 Ko ..... 439/108
6,790,087 B2 * 9/2004 Ho ..... 439/606
7,371,104 B2 * 5/2008 Wu ..... 439/358
2008/0132112 A1 * 6/2008 Nagata et al. ..... 439/499
2008/0214042 A1 * 9/2008 Kondo et al. ..... 439/466

FOREIGN PATENT DOCUMENTS

JP 2003-203715 7/2003

* cited by examiner

*Primary Examiner*—James Harvey
(74) *Attorney, Agent, or Firm*—Kratz, Quintos & Hanson, LLP

(57) ABSTRACT

An electronic connector includes a housing provided in a front surface thereof with an opening for receiving a mating connector, an inside of the opening being provided with a plurality of contacts in a mutually insulated manner, and a lead-connection assisting member provided on a rear side of the housing. The lead-connection assisting member includes a supporting table for supporting to solder rear-end wire connecting portions of the contacts projected from a rear surface of the housing and corresponding core wires taken from tip portions of leads for electrical connection, and a plurality of lead receiving grooves formed at the same pitch distance as that of the contacts, the grooves being adapted to receive and temporarily hold the tip portions of the leads.

11 Claims, 9 Drawing Sheets

ELECTRIC CONNECTOR

The present application claims priority under 35 U.S.C. §119 of Japanese Patent Application No. 2007-052719 filed on Mar. 2, 2007, the disclosure of which is expressly incorporated by reference herein in its entity.

BACKGROUND OF THE INVENTION

1. Field of the Invention

The present invention relates to an electric connector for use in a signal transmission cable.

2. Description of the Related Art

An electric connector of this type generally has a substantially rectangular parallelepiped housing made of plastics material, an opening for receiving a mating connector is formed on the front side of the housing, and an inner surface of the opening is provided with a plurality of contacts arranged along the width (e.g., Japanese Patent Application Laid-Open No. 2003-203715 and the like).

SUMMARY OF THE INVENTION

However, in the above-described conventional example, the fact is that cable connection is performed with manual soldering. Thus, not only mass productivity is unfavorable, but quantity of solder supplied varies depending on the skill of a worker performing the soldering, and the range of variation is too large and unstable to assume, thereby adversely affecting transmission characteristics of a produced connector. This is true of even the same worker. In connecting a multicore cable, variation in characteristic among transmission paths in the cable may result, which is a major factor impairing high performance of the product.

The present invention is devised in view of the above-described circumstances. An object of the present invention is to provide an electric connector suitable for performing collective soldering such as a pulse heating method.

An electrical connector according to the present invention includes a housing provided in a front surface thereof with an opening for receiving a mating connector, an inside of the opening being provided with a plurality of contacts in a mutually insulated manner; and a lead-connection assisting member arranged toward a rear of the housing. The lead-connection assisting member includes a supporting table for supporting to solder rear-end wire connecting portions of the contacts projected from a rear surface of the housing and corresponding core wires taken from tip portions of leads for electrical connection, and a plurality of lead receiving grooves formed at the same pitch distance as that of the contacts, the grooves being adapted to receive and temporarily hold the tip portions of the leads.

In the electric connector according to the present invention, the lead receiving grooves of the lead-connection assisting member temporarily hold the tip portions of the leads for electrical connection toward the rear of the housing, while the supporting table of the lead-connection assisting member supports the core wires taken from the tip portions of the leads and the rear-end wire connecting portions projected from the rear surface of the housing. Such configuration is suitable for collective soldering such as a pulse heating method, whereby bringing about the solution of various conventional problems with the variation in supplied solder quantity. The invention thus has great significance in pursuing improved performance capabilities and mass productivity of the connector.

Each of the lead receiving grooves may preferably has a little smaller width than the corresponding tip portion of the lead so that the tip portion of the lead can be pressed into and held in the lead receiving groove. Each lead receiving groove may also have barbs pointing inward at respective opposite ends of an open side thereof, the barbs preventing the tip portion of the lead from slipping off.

In this case, the invention is further advantageous in that the tip portions of the leads are precisely positioned and securely held, whereby the accuracy of the soldering is advantageously improved.

Where the lead-connection assisting member can be mounted on the rear side of the housing, it is preferable that the supporting table is provided with a plurality of guide grooves for guiding the rear-end wire connecting portions of the contacts, the guide grooves being arranged in communication with the lead receiving grooves. When the lead-connection assisting member is mounted on the rear side of the housing, the rear-end wire connecting portions of the contacts come into the guide grooves on the supporting tables and are guided to opposed positions to the lead receiving grooves. Due to ease in assembly, it is advantageous in reducing the cost of the connector.

Where a plate-like locking terminal holding portion is provided on each opposite widthwise end of the rear surface of the housing and oriented in the length direction of the connector, an inner surface of the locking terminal holding portion may have a guide for guiding the lead-connection assisting member movably in the length direction. The guide will ease installation of the lead-connection assisting member on the rear side of the housing. The assembly of the connector is thus facilitated, which is advantageous in reducing the cost of the connector.

Furthermore, the guide or the lead-connection assisting member may preferably have slipping-off preventing means for fixing the lead-connection assisting member to the rear side of the housing. The slipping-off preventing means will help to securely attach the lead-connection assisting member to the rear side of the housing. The assembly of the connector is thus yet easier, which is advantageous in reducing the cost of the connector.

It is also desirable that an insertable portion of the lead-connection assisting member functions as an impedance adjusting portion to be inserted into the opening of the housing from the rear side so as to adjust overall impedance of the contacts. For example, the lead-connection assisting member may be provided with a metal body at least one of inside and outside of the impedance adjusting portion; and/or the impedance adjusting portion of the lead-connection assisting member may be made of a material different from that of other portions.

If the tip insertable portion of the lead-connection assisting member functions as the impedance adjusting portion to be inserted into the opening of the housing from the rear side so as to adjust overall impedance of the contacts, the impedance of the overall contacts can easily adjusted by changing the dimensions, shape, material, etc. of the impedance adjusting portion, which is advantageous in pursuing improved performance capabilities and reduced cost of the connector. Moreover, the impedance adjusting portion inserted into the opening of the housing serves to prevent the deflection of the housing.

DESCRIPTION OF THE PREFERRED EMBODIMENT

Figure 1:
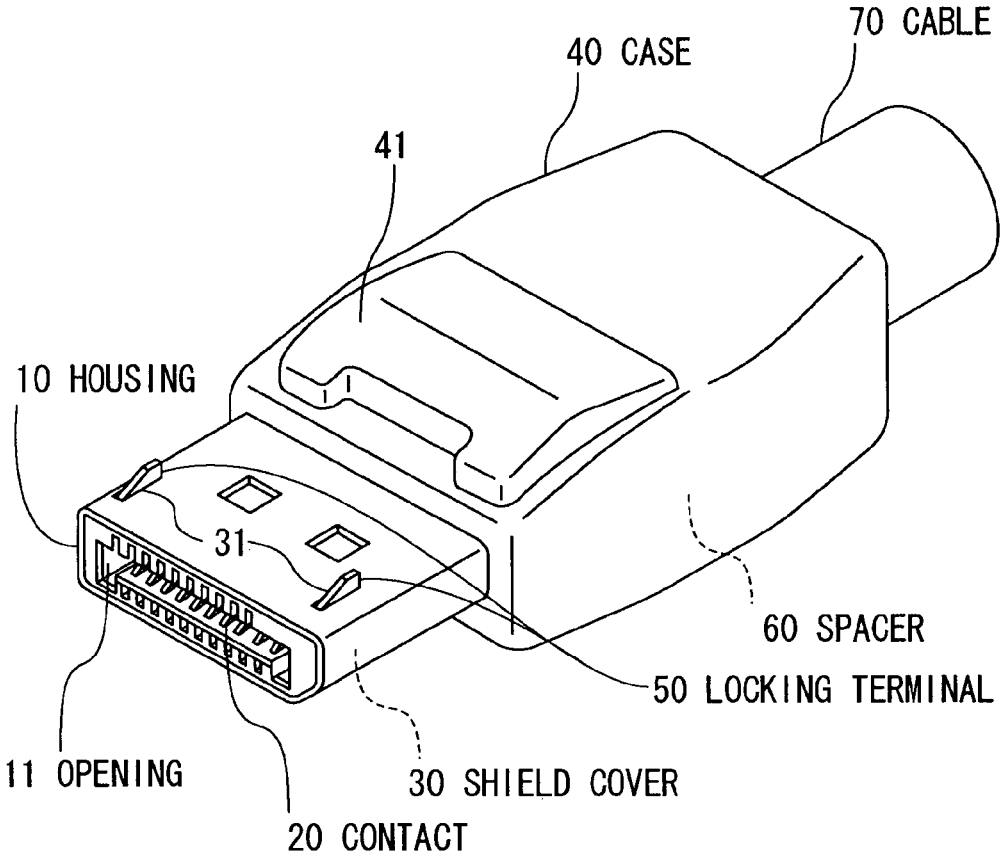
FIG. 1 is a perspective view illustrating an embodiment of an electric connector of the present invention.

Hereinafter, referring to the drawings, an embodiment of an electric connector according to the present invention is described. As shown in FIGS. 1 to 9, the electric connector described herein is a connector on the plug side to be attached to a tip portion of a bulk cable (cable 70) for high-speed signal transmission. The electric connector has a housing 10, contacts 20, a shield cover 30, a case 40, locking terminals 50, and a spacer 60.

Figure 4:
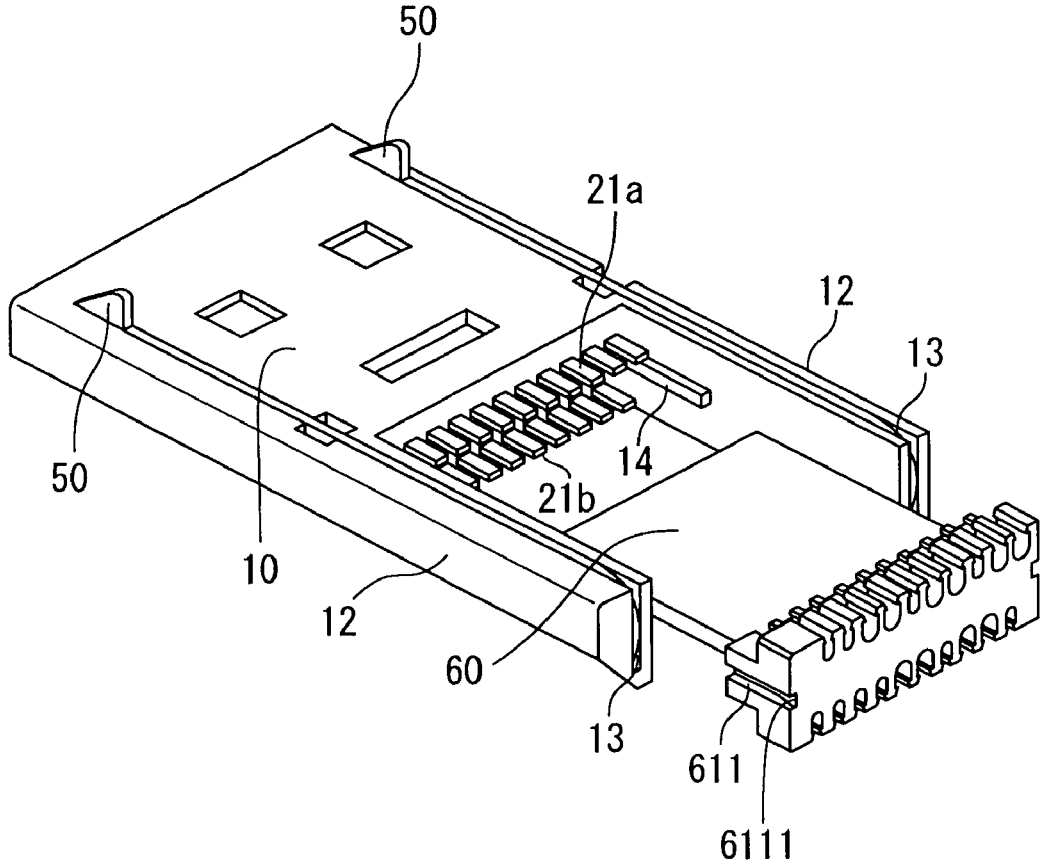
FIG. 4 is a perspective view of the inside of the electric connector, particularly illustrating a housing and a spacer thereof.
Figure 5:
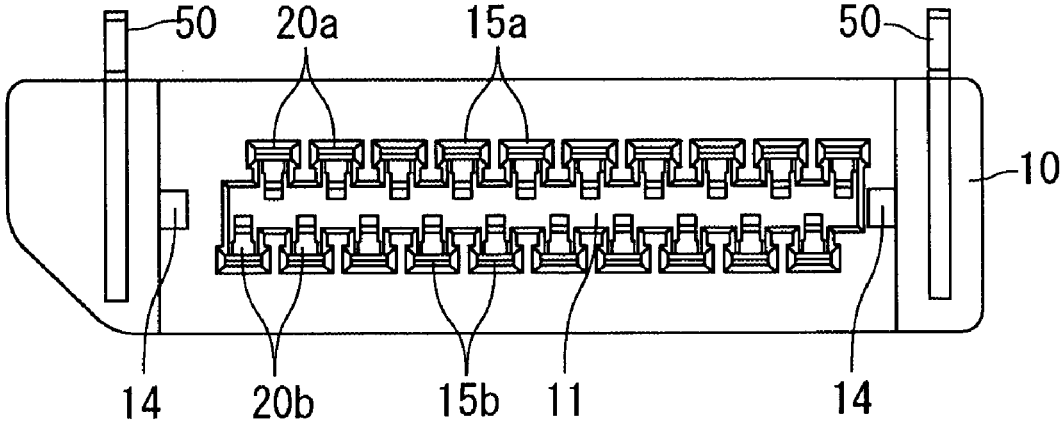
FIG. 5 is a back view of the housing.

The housing 10 is a substantially rectangular cylindrical body made of plastics material and has an opening 11 in a front surface thereof. The opening 11 is adapted to receive a connector on the receptacle side (not shown) provided in an electronic device or the like. As shown in FIGS. 4 and 5, inner surfaces of the opening 11 are provided with a plurality of contacts 20 in such a manner as to be insulated mutually. More particularly, ten grooves 15*a* are formed at the same pitch distance on an upper inner surface of the opening 11 of the housing along its length, and contacts 20*a* are inserted and attached into the grooves 15*a*. Also, grooves 15*b* are similarly formed on a lower inner surface of the opening 11 of the housing, and contacts 20*b* are inserted and attached into the grooves 15*b*. Each pitch distance of the grooves 15*a*, 15*b* is the same as that of contacts provided inside of the above-described receptacle connecter.

On each widthwise end of a rear surface of the housing 10, a plate-like locking terminal holding portions 12 extend in the length direction of the housing. Each locking terminal holding portions 12 has a groove 13 for inserting and attaching the locking terminal 50. The locking terminal 50 is a substantially U-shaped metal elastic body. Each of the locking terminal holding portions 12 is provided with a guide 14 in straight plate shape for guiding the spacer 60 movably in the length direction (see FIGS. 5 and 8).

Figure 6:
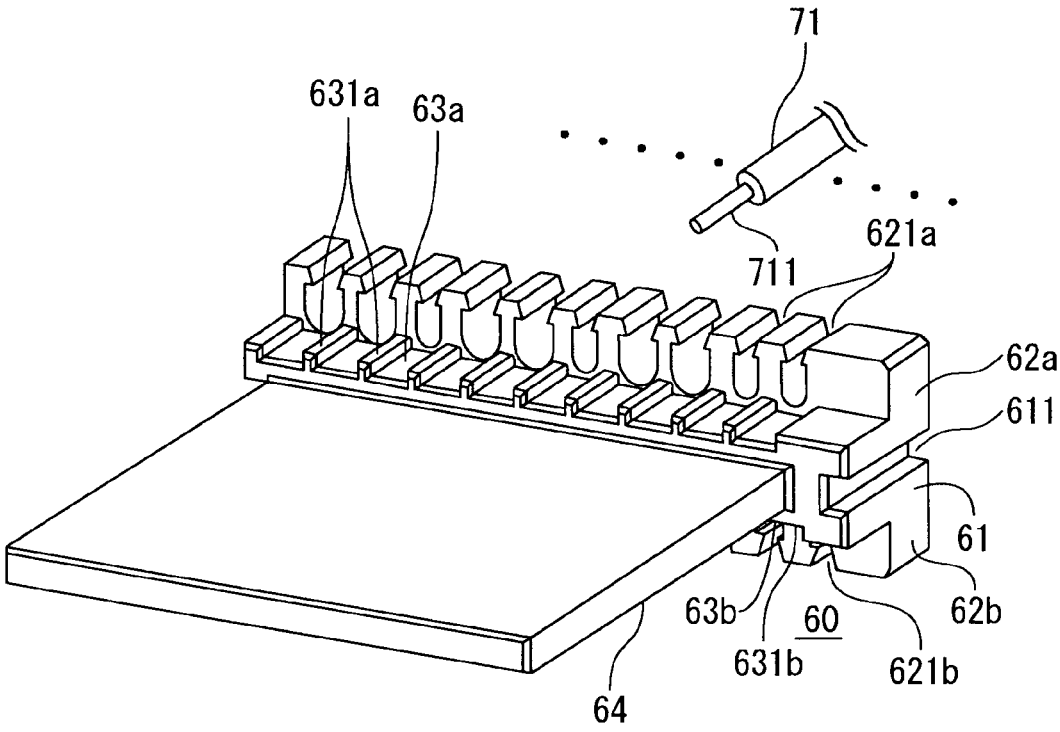
FIG. 6 is a perspective view of the spacer.
Figure 7:
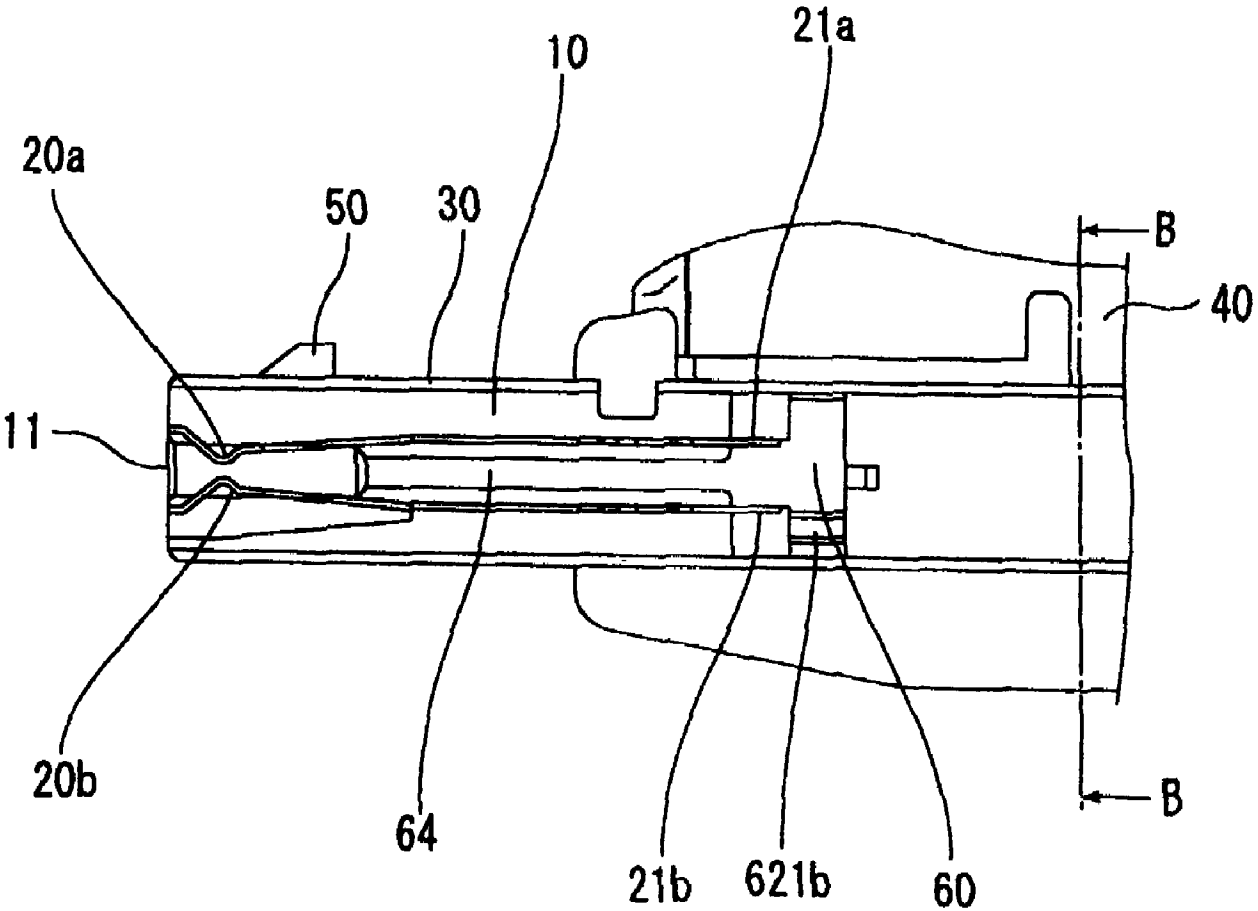
FIG. 7 is a cross-sectional view taken along A-A in FIG. 3.

The contacts 20*a*, 20*b* are metal plates with their tip portions are slightly bent as shown in FIG. 7. The contacts 20*a* and contacts 20*b* are attached to the upper surface and the lower surface to form upper and lower rows, respectively, inside the opening 11 of the housing 10 as described above. Rear-end wire connecting portions 21*a*, 21*b* of the contacts 20*a*, 20*b* are projected from the rear surface of the housing 10, as shown in FIGS. 4 and 7, and are soldered to core wires 711 taken from a plurality of leads 71 incorporated in the cable 70 (see FIG. 6).

The spacer 60 serves as a lead-connection assisting member and can be mounted on the rear side of the housing 10 as shown in FIGS. 4 and 6. The spacer 60 has a substantially rectangular parallelepiped base portion 61, vertical wall portions 62*a*, 62*b* extending upward and downward, respectively, on the base end side of the base portion 61, a plate-like insertable portion which functions as an impedance adjusting portion 64 provided on the tip end side of the base portion 6 and oriented in the length direction of the connector, and substantially plate-like supporting tables 63*a*, 63*b* formed on an upper surface and a lower surface of the base portion 61, and between the vertical wall portions 62*a*, 62*b* and the impedance adjusting portion 64, respectively.

The base portion 61, the vertical wall portions 62*a*, 62*b*, and the supporting tables 63*a*, 63*b* are integrally molded of plastics material. This integrally molded member consisting mainly of the base portion 61 is fixed firmly to the impedance adjusting portion 64 to make up the spacer 60.

Guide grooves 611, 611 for accommodating the guides 14 of the housing 10 are formed in opposite widthwise side surfaces of the base portion 61. In the rear end portions of the guide grooves 611, there are formed inclined surfaces 6111 inclined upward toward the rear widthwise end. These inclined surfaces 6111 serve as slipping-off preventing means for fixing the spacer 60 to the rear side of the housing 10.

Figure 8:
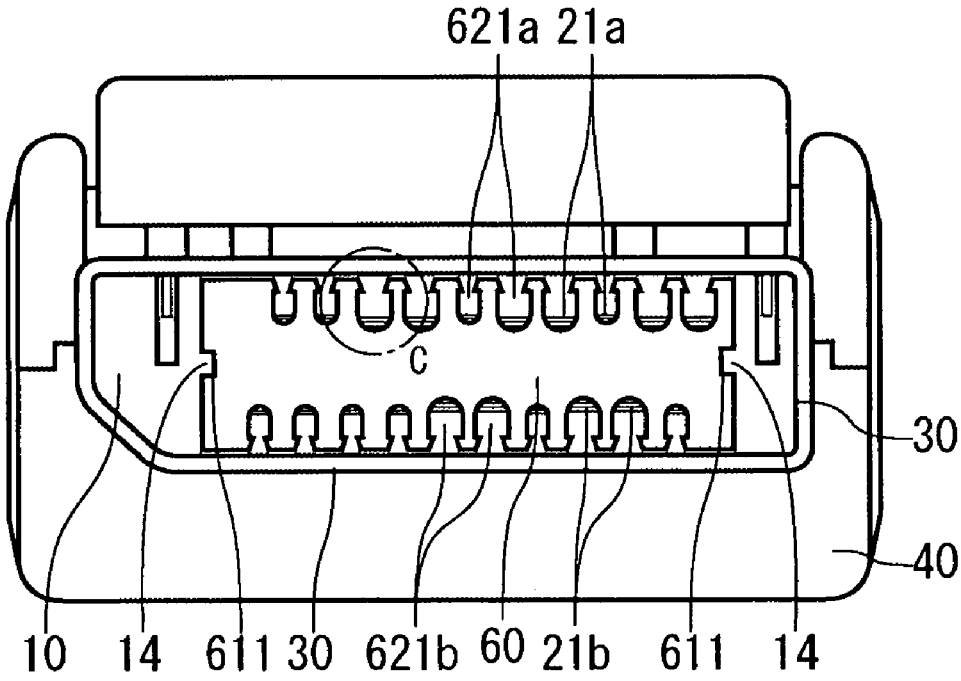
FIG. 8 is a cross-sectional view taken along B-B in FIG. 7.
Figure 9:
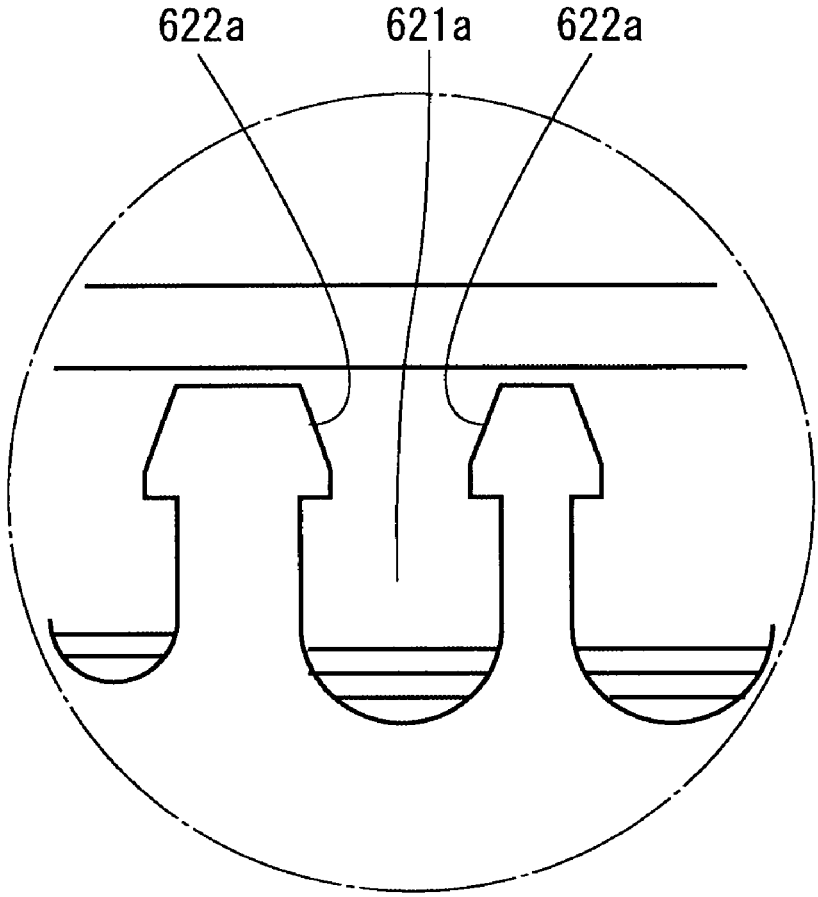
FIG. 9 is an enlarged view of an area "C" in FIG. 8.

The vertical wall portions 62*a*, 62*b* have lead receiving grooves 621*a*, 621*b*, respectively, as shown in FIGS. 6 and 8. These grooves are used to receive and temporally hold the tip portions of the leads 71 of the cable 70 at the same pitch distance as that of the contacts 20*a*, 20*b*. Each of the lead receiving grooves 621*a*, 621*b* has a little smaller width than the tip portion of the lead 71 so that the tip portion of the lead 71 can be pressed into and held in the groove. Additionally, as shown in FIG. 9, each of the lead receiving grooves 621*a* is formed with barbs 622*a*, 622*a* pointing inward at opposite ends of the open end thereof. The barbs prevent the tip portion of each of the leads 71 from slipping off. The lead receiving grooves 621*b* also have the same constitution as 621*a*.

The insertable portion which functions as an impedance adjusting portion 64 is inserted from the rear side of the opening 11 of the housing 10 and serves to adjust impedance of the overall regions of the contacts 20*a*, 20*b*. In this case, the insertable portion which functions as an impedance adjusting portion 64 is different in material, as well as in a length, shape, etc., from the base portion 61 and the other portions. Consequently, changing permittivity of the insertable portion which functions as an impedance adjusting portion 64 allows capacitance of the overall regions of the contacts 20*a*, 20*b* to be adjusted.

The supporting tables 63*a*, 63*b* serve to support the rear-end wire connecting portions 21*a*, 21*b* of the contacts 20*a*, 20*b* projected from the rear surface of the housing 10 and the core wires 711 taken from the tip portions of the leads 71 of the cable 70 for soldering. On the surfaces of the supporting tables 63*a*, 63*b*, guide grooves 631*a*, 631*b* are formed in communication with the lead receiving grooves 621*a*, 621*b*, respectively, for guiding the rear-end wire connecting portions 21*a*, 21*b* of the contacts 20*a*, 20*b*.

Figure 2:
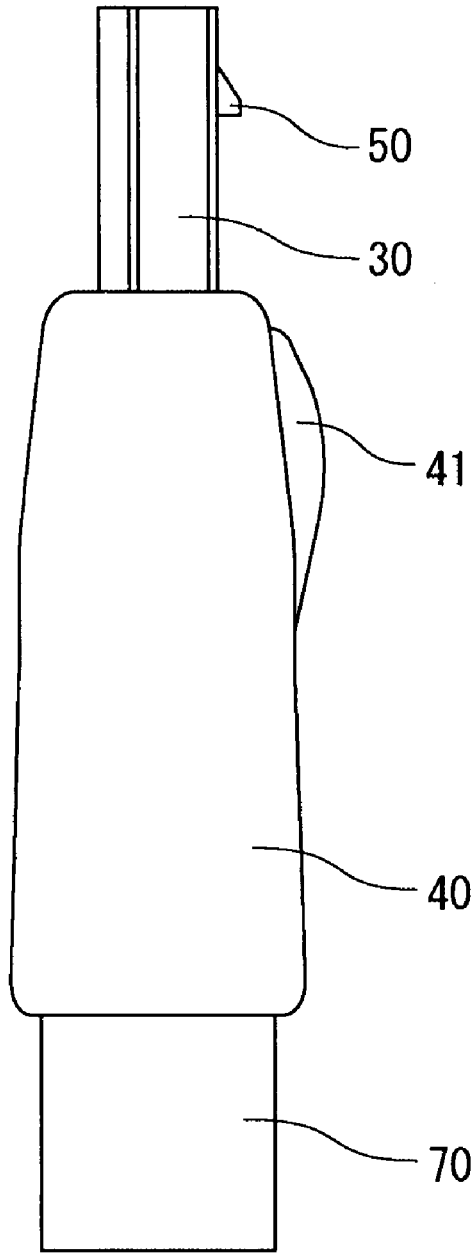
FIG. 2 is a side view of the same electric connector.
Figure 3:
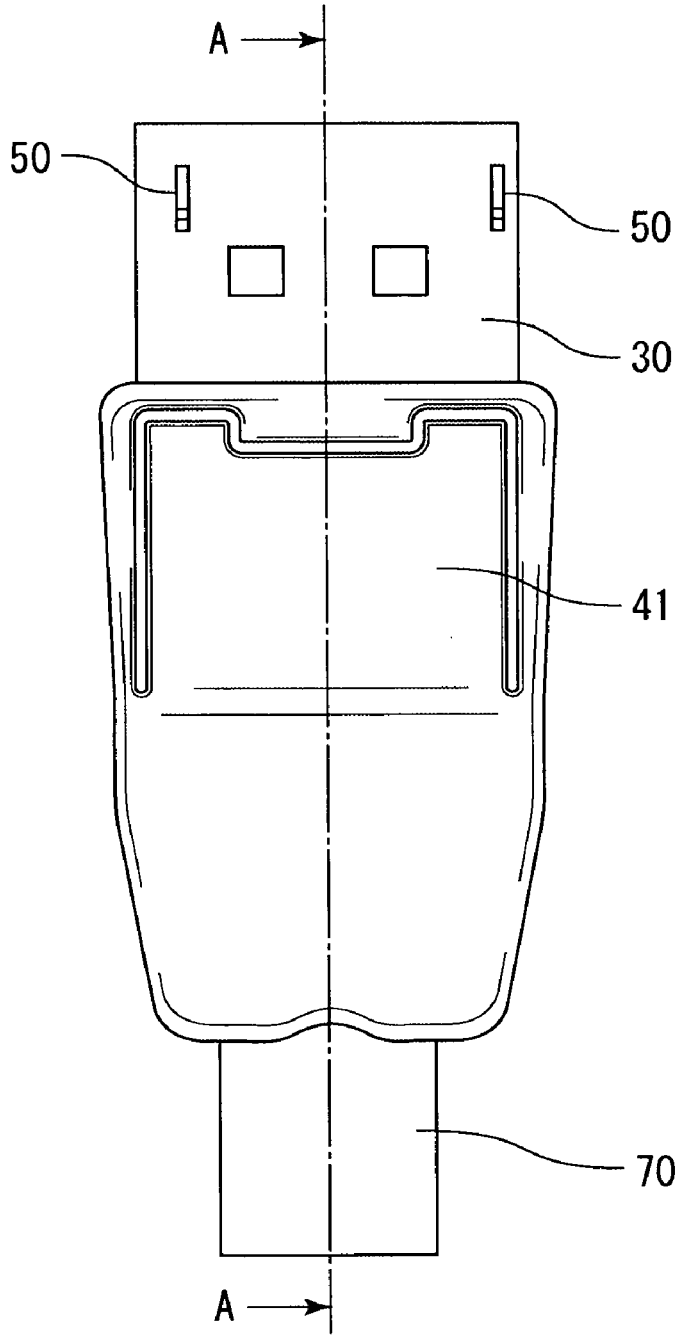
FIG. 3 is a plan view of the same electric connector.

The shield cover 30 is a rectangular cylindrical shell covering an outer peripheral surface of the housing 10, as shown in FIGS. 1 to 3. Toward the tip side of opposite sides of an upper surface of the shield cover 30, holes 31 for receiving tip portions of the locking terminals 50 are formed.

The case 40, molded of plastics material, protects a base end portion of the shield cover 30, the whole of the housing 10, and the whole of the spacer 60. An upper surface of the case 40 provided with a push button 41 for switching between lock and unlock with the above-described receptacle type connector. That is, as the push button 41 is connected to base end portions of the locking terminals 50 inside the case 40, the tip portions of the locking terminals 50 can be moved up and down through the push button 41.

In the electric connector constituted as described above, the lead receiving grooves 621*a*, 621*b* of the spacer 60 temporarily hold the tip portions of the leads 71 of the cable 70 at the rear side of the housing 10, while the supporting tables 63*a*, 63*b* of the spacer 60 support the core wires 711 taken from the tip portions of the leads 71 and the rear-end wire connecting portions 21*a*, 21*b* of the contacts 20*a*, 20*b* projected from the rear surface of the housing 10. In this state, it is possible to perform collective soldering such as a pulse heating method, resulting in improved mass productivity of the connector.

Additionally, not only the barbs 622*a*, 622*b* prevent the tip portions of the leads 71 of the cable 70 from easily slipping off from the lead receiving grooves 621*a*, 621*b*, but the leads 71 are pressed into the lead receiving grooves 621*a*, 621*b* and held therein. Such configuration allows secure positioning and significantly improves the soldering accuracy. Thus, the improved transmission characteristics of the connector will contribute to improved performance of the connector.

Moreover, changing the material, etc. of the impedance adjusting portion 64 of the spacer 60 allows easy impedance adjustment of the overall regions of the contacts 20. The impedance adjusting portion 64 also prevents the deflection of the housing 10 because it is inserted into the opening 11 of the housing 10. Additionally, the spacer 60, arranged inside the locking terminal holding members 12 of the housing 10, reinforces the locking terminal holding members 12. Thus, mechanical strength of the whole connector is improved, contributing to reduction in size and thickness of the connector.

Furthermore, the spacer 60 can be easily mounted on the rear side of the housing 10 because the guides 14 for guiding the spacer 60 movably in the length direction are provided on the respective inner walls of the locking terminal holding members 12 of the housing 10. The spacer 60 can be securely mounted because it has the slipping-off preventing means. This further eases the assembly of the connector, which is an advantage in reducing the cost of the connector.

Needless to say, the electric connector according to the present invention is not limited to those in the above-described embodiment on the type, shape, material, number of pins and the like. The present invention is similarly applied to a receptacle type connector. The lead-connection assisting member may be changed in design as needed, e.g. in accordance with the type of the connector, as long as it is arranged on the rear side of the housing and has similar functions to those of the above-described supporting tables and lead receiving grooves. Moreover, in the case where the impedance adjusting portion and the other portions are integrally formed of the same material, the impedance adjustment may be achieved by providing a metal body inside the impedance adjusting portion by insert molding or the like, or by providing a metal body outside the impedance adjusting portion by deposition or the like.

What is claimed is:

1. An electric connector comprising:

a housing provided in a front surface thereof with an opening or receiving a mating connector, an inside of the opening being provided with a plurality of contacts in a mutually insulated manner; and a lead-connection assisting member mountable on a rear side of the housing, wherein the lead-connection assisting member comprises:

a supporting table for supporting to solder rear-end wire connecting portions of the contacts projected from a rear surface of the housing and corresponding core wires taken from tip portions of leads for electrical connection, and a plurality of lead receiving grooves formed at the same pitch distance as that of the contacts, the grooves being adapted to receive and temporarily hold the tip portions of the leads, wherein the supporting table is provided with a plurality of guide grooves for guiding the rear-end wire connecting portions of the contacts, the guide grooves being arranged in communication with the lead receiving grooves, wherein a plate-like locking terminal holding portion is provided on each opposite widthwise end of the rear surface of the housing and oriented in the length direction of the connector, and wherein an inner surface of the locking terminal holding portion has a guide for guiding the lead-connection assisting member movably in the length direction.

2. The electric connector according to claim 1, further comprising:

a shield cover for covering a outer peripheral surface of the housing; and a case for protecting the whole of a base end portion of the electric connector, wherein the plurality of contacts are arranged respectively on opposed inner sides of the opening of the housing so as to form two rows of contacts.

3. The electric connector according to claim 1, wherein each of the lead receiving grooves has a little smaller width than the corresponding tip portion of the lead so that the tip portion of the lead can be pressed into and held in the lead receiving groove.

4. The electric connector according to claim 1, wherein each of the lead receiving grooves has barbs pointing inward at respective opposite ends of an open side thereof, the barbs preventing the tip portion of the lead from slipping off.

5. An electric connector comprising:

a housing provided in a front surface thereof with an opening for receiving a mating connector, an inside of the opening being provided with a plurality of contacts in a mutually insulated manner; and a lead-connection assisting member provided on a rear side of the housing, wherein the lead-connection assisting member comprises;

a supporting table for supporting to solder rear-end wire connecting portions of the contacts projected from a rear surface of the housing and corresponding core wires taken from tip portions of leads for electrical connection, and a plurality of lead receiving grooves formed at the same pitch distance as that of the contacts, the grooves being adapted to receive and temporarily hold the tin portions of the lead, and an insertable portion to be inserted into the opening of the housing from the rear so as to function as an impedance adjusting portion for adjusting overall impedance of the contacts.

6. The electric connector according to claim 5, wherein the lead-connection assisting member further comprises a metal body at least one of inside and outside of the impedance adjusting portion.

7. The electric connector according t claim 1, wherein the guide or the lead-connection assisting member has slipping-off preventing means for fixing the lead-connection assisting member to the rear side of the housing.

8. The electric connector according to claim 5, wherein in the lead-connection assisting member, the impedance adjusting portion is made of a material different from that of other portions.

9. The electric connector according to claim 5, further comprising:

a shield cover for covering an outer peripheral surface of the housing; and a case for protecting the whole of a base end portion of the electric connector, wherein the plurality of contacts are arranged respectively on opposed inner sides of the opening of the housing so as to form two rows of contacts.

10. The electric connector according to claim 5, wherein each of the lead receiving grooves has a little smaller width than the corresponding top portion of the lead so that the tip portion of the lead can be pressed into and held in the lead receiving groove.

11. The electric connector according to claim 5, wherein each of the lead receiving grooves has barbs pointing inward at respective opposite ends of an open side thereof the barbs preventing the tip portion of the lead from slipping off.

* * * * *